United States Patent [19]

Wood et al.

[11] 4,357,856

[45] Nov. 9, 1982

[54] PROPELLANT FOR LIQUID PROPELLANT GUN

[75] Inventors: Stanley E. Wood, Inyokern; James T. Bryant, China Lake, both of Calif.

[73] Assignee: The United States of America as represented by the Secretary of the Navy, Washington, D.C.

[21] Appl. No.: 741,822

[22] Filed: Nov. 12, 1976

[51] Int. Cl.[3] ..... F41F 1/04

[52] U.S. Cl. ..... 89/7; 60/217; 149/74; 102/440

[58] Field of Search ..... 60/208, 211, 213, 217; 89/7; 149/74; 102/440

[56] References Cited

U.S. PATENT DOCUMENTS

| | | | |
|---|---|---|---|
| 3,113,421 | 12/1963 | Koch | 60/208 |
| 3,113,425 | 12/1963 | Smith et al. | 60/208 |
| 3,113,426 | 12/1963 | Smith et al. | 60/208 |
| 3,165,887 | 1/1965 | Koch | 60/208 |
| 3,177,653 | 4/1965 | Barnes et al. | 60/208 |
| 3,969,979 | 7/1976 | Schneider et al. | 89/7 |

OTHER PUBLICATIONS

The Condensed Chemical Dictionary 9th Ed., Van Nostrand Reinhold Co., New York, 1977, p. 256.

Wertheim, Textbook of Organic Chemistry, McGraw-Hill Book Co., N.Y. 1951, 3rd Ed., pp. 685 and 686.

*Primary Examiner*—Leland A. Sebastian

*Attorney, Agent, or Firm*—R. F. Beers; W. T. Skeer

[57] ABSTRACT

A mixture of aqueous nitric acid (about 90 volume percent $HNO_3$ and 10 volume percent $H_2O$) and Decalin are used as a propellant for a liquid propellant gun.

6 Claims, No Drawings

PROPELLANT FOR LIQUID PROPELLANT GUN

BACKGROUND OF THE INVENTION

1. Field of the Invention

This invention relates to propellants for a liquid propellant guns.

2. Description of the Prior Art

Considerable experimentation is now being carried on with liquid propellant guns. A liquid propellant gun is one in which a liquid propellant rather than conventional powder is utilized to provide the force which drives a projectile from the gun barrel. In a typical experimental liquid propellant gun, two liquid components, an oxidizer and a fuel, are injected into a chamber behind a projectile and sparked whereupon they burn, and produce gases which drive the projectile out of the barrel.

The liquid components must be of a nature such that they do not spontaneously ignite even when mixed in a very hot chamber. Quite obviously one would not wish to have a liquid propellant gun, or any other gun for that matter, fire spontaneously upon insertion of the propellant. Since many or perhaps most possible combinations of liquid oxidizer and fuel components tend to ignite spontaneously when mixed in a hot chamber, not many such combinations have become candidates for use as propellants for liquid propellant guns. In the past, n-octane and red fuming nitric acid (and other nitric acid concentrations) have been experimented with, with some success. This combination has drawbacks in that n-octane is expensive and the ballistic reproducability of the mixture leaves something to be desired. Also, combinations of TH-Dimer and nitric acid have been experimented with. These combinations have a drawback in that the TH-Dimer is a complex mixture of isomers which vary from batch to batch. Certain isomers are excessively reactive with nitric acid and this leads to "cook-off" problems. The ballistic reproducability of this combination also leaves something to be desired. Exo-tetrahydrodicyclopentadiene and nitric acid have also been experimented with and have yielded excellent results. However, the flash point of the exo compound is only about 132° F. and this is lower than the 140° F. specified for Navy shipboard applications. Also, the exo compound is not currently a commercially available material.

SUMMARY OF THE INVENTION

According to this invention decalin and aqueous nitric acid are used as a propellant for liquid propellant guns. The aqueous nitric acid preferably contains about 90 volume percent nitric acid and about 10 volume percent water. However, solutions containing from 85 to 95 volume percent nitric acid and 15 to 5 volume percent water are suitable. Oxidizer to fuel ratio of from 2.24 to 1 up to 5.0 to 1 have been successfully tested and experimental results have shown excellent ballistic reproducability.

DESCRIPTION OF THE PREFERRED EMBODIMENT

As pointed out above in the Description of the Prior Art, a liquid propellant gun is one in which two liquid components are injected into a chamber behind a projectile and sparked whereupon they burn and produce hot gases which drive the projectile from the barrel. The projectile, at the time the two components are injected, is naturally located in the rear of the barrel.

After repeated burnings of liquid propellant take place in a chamber as they must in a multi-shot weapon, the chamber naturally becomes hot. Injection of cold propellant cools the chamber somewhat but is not 100% efficient. Typically, an ignition chamber may reach several hundred degrees fahrenheit after a rapid burst. Accordingly, the components of the liquid propellant must be of such a nature that they will not spontaneously ignite at elevated temperatures. Actually, it would be preferable if the components were of a nature such that they would not spontaneously ignite when mixed at any temperature. However, such a combination obviously does not exist. After all, in order to do their job, the mixture of oxidizer and fuel components must ignite when sparked.

In experiments, mixtures containing a ratio of from 2.24 parts by volume of oxidizer (aqueous nitric acid) to 1 part by volume fuel (Decalin) up to 5 parts by volume oxidizer to 1 part by volume fuel were used. A 3:1 ratio of oxidizer to fuel (by volume) appears to be best. However, all ratios within these limits yield excellent ballistic reproducability. In a typical burst, peak pressures in the firing chamber are on the order of about 70,000 psi with standard deviations of only about ±3,000 psi. Muzzle velocities vary by less than ±1 percent.

Decalin has advantages as a fuel in that its flash point is about 140° F. and thus meets specifications for shipboard use and in that it is a readily available commercial solvent.

In the experiments, a 90 volume percent nitric acid—10 volume percent water solution was used. However, 85 volume percent nitric acid—10 volume percent water solutions have been tested with Decalin in all tests ordinarily carried out except in actual firing tests and have passed all such tests.

In actual firing tests conducted with Decalin—aqueous nitric acid propellant, the longest bursts to date have been achieved and spontaneous ignition of the propellant upon injection into the firing chamber has not been a problem. In fact, the only problems encountered have been mechanical problems with the test weapons. That is, the liquid propellant has given no problems at all.

What is claimed is:

1. In a method for propelling a projectile from a gun barrel wherein a propellant is injected into a firing chamber behind said projectile and ignited, the improvement residing in using, as said propellant, a mixture of decahydronaphthalene nitric acid oxidizer.

2. In a method according to claim 1, the further improvement residing in using an oxidizer to decahydronaphthalene ratio in the range of from 2.24 parts by volume oxidizer to 1 part by volume decahydronaphthalene to 5 parts by volume oxidizer to 1 part by volume decahydronaphthalene.

3. A method according to claim 2, the further improvement residing in using an aqueous solution of nitric acid oxidizer containing from 85 to 95 volume percent nitric acid and from 15 to 5 volume percent water.

4. A liquid propellant composition comprising decahydronaphthalene and aqueous nitric acid.

5. The composition of claim 4 wherein the aqueous solution of nitric acid contains 85 to 95 volume percent nitric acid and from 15 to 5 volume percent water.

6. The composition of claim 4 wherein the oxidizer to decahydronaphthalene ratio is in the range of from 2.24 parts by volume oxidizer to 1 part by volume decahydronaphthalene to 5 parts by volume oxidizer to 1 part by volume decahydronaphthalene.

* * * * *